US006881301B2

(12) United States Patent
Heikkinen et al.

(10) Patent No.: US 6,881,301 B2
(45) Date of Patent: Apr. 19, 2005

(54) METHOD AND ARRANGEMENT FOR CONTROLLING MOISTURE IN A MULTIROLL CALENDER

(75) Inventors: Antti Heikkinen, Helsinki (FI); Pekka Linnonmaa, Järvenpää (FI); Reijo Pietikäinen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 70 days.

(21) Appl. No.: 10/240,919

(22) PCT Filed: Apr. 3, 2001

(86) PCT No.: PCT/FI01/00319

§ 371 (c)(1),
(2), (4) Date: Jan. 29, 2003

(87) PCT Pub. No.: WO01/75224

PCT Pub. Date: Oct. 11, 2001

(65) Prior Publication Data

US 2004/0025720 A1 Feb. 12, 2004

(30) Foreign Application Priority Data

Apr. 4, 2000 (FI) ..... 20000788

(51) Int. Cl.[7] ..... D21G 1/00

(52) U.S. Cl. ..... 162/206; 162/118; 162/204; 162/205; 162/252; 162/283; 162/361; 100/74; 100/162 R; 100/173; 100/331

(58) Field of Search ..... 162/135–137, 162/204–207, 252, 265, 360, 361, 358.1, 358.3, 362, 118, 263, 271, 283, 198; 100/73–75, 305, 331, 161, 162 R, 173, 333; 226/97.1, 97.2, 97.3

(56) References Cited

U.S. PATENT DOCUMENTS 4,342,413 A * 8/1982 Reba ..... 242/615.12
4,642,164 A * 2/1987 Hanhikoski et al. ..... 162/207
4,763,822 A * 8/1988 Mohrsen ..... 226/91
4,804,125 A * 2/1989 Vits ..... 242/615.11
5,045,342 A 9/1991 Boissevain et al.
5,950,899 A * 9/1999 Bassa ..... 226/196.1
6,004,432 A * 12/1999 Page et al. ..... 162/281
6,207,019 B1 * 3/2001 Zwart et al. ..... 162/207
6,634,120 B1 * 10/2003 Helmer et al. ..... 34/585
6,694,640 B1 * 2/2004 Kayser ..... 34/402

FOREIGN PATENT DOCUMENTS

EP 1 026 318 A2 8/2000
WO WO 00/79049 A2 12/2000
WO WO 01/75224 A1 10/2001

OTHER PUBLICATIONS

Smook, G.A., Handbook for Pulp and Paper Technologists, Ch. 18–3 "Supercalendering", pp. 294–296.*

Search Report issued in Finnish Application No. 20000788.

International Search Report issued in International Patent Application No. PCT/FI01/00319.

International Preliminary Examination Report issued in International Patent Application No. PCT/FI01/00319.

* cited by examiner

*Primary Examiner*—Peter Chin
*Assistant Examiner*—Eric Hug
(74) *Attorney, Agent, or Firm*—Stiennon & Stiennon

(57) ABSTRACT

A method and an arrangement for controlling evaporation and moisture in a multinip calender (10) when a continuous fibrous web (W) is calendered in calendering nips (1, 2, 3, 4, 5) placed one after the other before the fibrous web is wound on a reel-up/winder (9). With a view to making the net evaporation from and the final moisture content of the web (W) constant when the running situations in the calender (10) change, the web is passed in the calender from the outlet of at least one nip into an air-float chamber (20) of the turning airborne type.

20 Claims, 2 Drawing Sheets

METHOD AND ARRANGEMENT FOR CONTROLLING MOISTURE IN A MULTIROLL CALENDER

CROSS REFERENCES TO RELATED APPLICATIONS

This application is a U.S. national stage application of International Application No. PCT/F101/00319, filed Apr. 3, 2001, and claims priority on Finnish Application No. 20000788 filed Apr. 4, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to paper and board machines. More specifically, the present invention relates to a method and an arrangement for controlling evaporation and moisture in a multinip calender when a continuous fibrous web is calendered in calendering nips placed one after the other before the fibrous web is wound on a reel-up/winder.

Calendering is a method by means of which the properties, such as smoothness, of a web-like material, such as a paper or board web, are sought to be generally improved. In calendering the web is passed into a nip which is formed between rolls pressed against each other and in which the web is deformed by the action of temperature, moisture and nip load, in which connection the physical properties of the web can be affected by controlling the above-mentioned parameters and the time of action, and the obtained smoothness is a function of the work done to the web.

In the papermaking art, grades of ever higher quality are required today. As the running speeds required of paper machines are continuously increasing, the direction in calendering technology is more and more towards on-line solutions, which include soft calendering and multinip on-line calendering. When the aim is to make higher quality printing paper grades having a PPS surface smoothness <2 μm, such as, for example, SC-A and LWC-roto grades and glossy coated paper grades, a substantial problem is that these kinds of grades can be produced in practice only by using, after drying a fibrous web, intermediate winding and off-line supercalenders, several of said supercalenders, usually three, being used side by side to meet production capacity.

Supercalendering is calendering in a calender unit in which nips are formed between a smooth-surface press roll, such as a metal roll, and a roll covered with a resilient cover, such as a polymer roll. The resilient-surface roll adapts itself to the contours of the surface of paper and presses the opposite side of paper evenly against the smooth-surface press roll. Today, the supercalender typically comprises 10–12 nips and for the purpose of treating the sides of the web, the supercalender comprises a so-called reversing nip in which there are two resilient-surface rolls against each other. Supercalendering is an off-line calendering method, and at the moment it provides the best paper qualities having a PPS surface smoothness <1.5 μm, such as, for example, WFC, LWC-roto and. SC-A.

Multinip on-line calendering is calendering in a calender unit in which nips are formed between a smooth-surface press roll, such as a metal roll, and a roll covered with a resilient cover, such as a polymer roll, which rolls are placed alternately one after the other. The resilient-surface roll conforms to the contours of the surface of paper and presses the opposite side of paper evenly against the smooth-surface press roll. A multinip on-line calender unit typically comprises 8 rolls and 7 nips. Linear load increases in the multinip on-line calender, in the same manner as in the supercalender, from the top nip to the bottom nip because of the force of gravity. Multinip on-line calendering is a calendering method by means of which it is possible to produce grades having a PPS surface smoothness >1.0 μm, such as, for example, film coated LWC and SC-C as well as lower-quality offset LWC and SC-B.

Soft calendering is calendering in a calender unit in which nips are formed between a smooth-surface press roll, such as a metal roll, and a roll covered with a resilient cover, such as a polymer roll. In a soft calender, the nips are formed between separate roll pairs. In order to treat both sides of the web in the soft calender, the order of the roll pairs forming the successive nips is inverted with respect to the web so that the resilient-surface roll may be caused to work on both surfaces of the web. Soft calendering is an on-line calendering method by means of which it is possible to produce grades having a PPS surface smoothness >1.5 μm, such as, for example, MFC and lower-quality film coated LWC as well as SC-C.

Linear load increases in multinip calenders from the top nip to the bottom nip because of the force of gravity. In order to eliminate this downwardly increasing linear load, to control the deflection line of the roll, and also to quickly open the set of rolls, today's multiroll calenders employ roll relieving which is accomplished by means of a cylinder and lever arm mechanism and which compensates for the force of gravity. One such relieving system for rolls is provided in OptiLoad™ calenders.

Smoothness/work done on OptiLoad™ calenders roughly complies with the pattern shown in the graph of FIG. 2.

By means of the initial moisture content of the web before the calender and by means of the calendering temperature and steam treatments of the web the smoothness/impulse curve can be displaced, in particular in the temperature range of 100 EC–150 EC, typically by 0.2 μm in the smoothness scale in its direction.

Today, calendering problems are mainly caused by the following matters.

a. Initial moisture content, the number of steam treatments and calendering temperature are mainly determined on the basis of the final moisture content after calendering such that
   i. when the final moisture content is too low, the web absorbs moisture, which results in deterioration of the achieved gloss in the form of after-roughening, and
   ii. when the final moisture content is too high, the drying of the web effectively destroys the obtained quality values.

b. On the other hand, determination of the initial moisture content in calendering is affected by the desired optical properties and the level of blackening. When the final moisture content becomes too high, the opacity, or translucence, of the web deteriorates, which appears in finished paper product as an increase in print-through values, and the level of blackening rises, which diminishes the selling value of paper in the form of reduced brightness and poor visual impression.

Because of these matters, the real control variables of a modern calender are relatively limited and the operating window of a single calender has become relatively narrow with increasing drying capacity of the calender. Today, quality can be successfully improved in practice only by increasing the number of nips of the calender. In connection with this, the controllability problem is aggravated by the fact that with increasing number of nips, difficulties also increase in setting the initial moisture content and initial temperature of the web such that curl of the web is avoided and that the web is still sufficiently moist in the lowermost nips of the calender and thus mouldable, which is of high significance for achieving smoothness in particular and also density.

In known multinip calenders, the web is usually passed from one nip to another by means of take-out or turning rolls, which are each situated at the take-out of the nip. It is also known that in connection with the take-out of the nip there are provided different steam boxes, spray devices and equivalent, by which attempts are made to control the change of the moisture content of the web.

Today, the final and initial moisture contents are largely dependent on the properties of fibre material and on the functional properties required of the end product, and since the best result is achieved by simultaneously controlling the calendering and final moisture content, which should be close to the equilibrium moisture content in a situation of final use in order to avoid large roughening and dimensional change effects, the primary object of the invention is not only to reduce the above-noted drawbacks and problems associated with calendering but also to generally improve control of evaporation and moisture in the calender in order to increase the quality potential at a given impulse level. Evaporation and drying of the web occurring in different running situations are strongly dependent on running speed, linear load and temperature, wherefore moisturizing and, thus, final quality and final moisture content are very difficult to control in different situations when there is a change in the calender. For this reason, an object of the invention is also to improve controllability in order that the moisture content of the web might be controlled in different situations of operation of the calender, for example, when there are changes in speed, roll temperatures and linear load.

SUMMARY OF THE INVENTION

The invention is thus based on the new and inventive idea that by replacing one or more take-out rolls with an air-float chamber of the turning airborne type, the net evaporation from and the final moisture content of the web can be made constant in different running situations. Thus, in accordance with the invention, it is advantageous that the calender comprises an air-float chamber of the turning airborne type in connection with the outlet of at least one nip. In a multiroll calender, the best result is achieved when there are several air-float chambers and preferably in connection with the outlet of each nip, in which connection moisture and evaporation can be made constant in the area of the entire calender, with the result that the web is not subject to large drying/moisturizing cycles, which is advantageous from the point of view of strength, dimensional stability, curling and after-roughening.

As an essential advantage associated with the invention it shall be further mentioned that by means of the invention retaining of the core moisture in the web is improved and, owing to this, higher temperatures can generally be used in calendering. The most effective way to mould, for example, paper is to mould fibre polymers at temperatures which are higher than the glass transition temperature, wherefore a substantial increase in temperature becomes possible in particular in multinip calenders with 6 and 8 rolls. With respect to advantages, it may be further mentioned that air-conditioning in the machine hall can be reduced and, in connection with SC paper, steam boxes can be dispensed with.

When the moisture level in a paper web is 5–10%, so-called glass transition temperatures are in the range of 120–90 EC, said glass transition temperature being the middle of the glass transition region characteristic of each fibre polymer pulp, such as mechanical and chemical fibre pulp, and the mouldability of pulp and thereby its capability of being calendered being at their best at said glass transition temperature. In a multinip calender with 6 or 8 rolls, in which the surface temperatures of the rolls are today typically 140–150 EC, because of high running speeds, the temperature of the web can rise only to the level of 80–70 EC, which is substantially below optimal calendering temperature, but the moisture control according to the invention makes it possible to preserve the core moisture of the web and thus to use higher calendering temperatures, with the result that the temperature of the web can be raised to an optimal level of 120–90 EC corresponding to the glass transition temperature. In calenders with 10 and 12 rolls, the temperature of the web rises because of the longer dwell time to a clearly higher level than in calenders with 6 and 8 rolls. In today's calenders with 10 or 12 rolls, typical drying of the web in the last nips, however, limits the use of temperatures and, in practice, the surface temperatures of rolls remain at about 120 EC and the temperature of the web remains at a level of about 90 EC, which is only just within the optimal calendering temperature range. Controlling moisture in accordance with the invention enables the core moisture of the web to be preserved and thus calendering temperatures to be used which are considerably higher than today's temperatures, i.e. 150 EC max, in which connection the temperature of the web can be raised to a clearly optimal level of 120–90 EC corresponding to the glass transition temperature. A further advantage of the invention is that the arrangement according to the invention for control of the moisture content of the web can be used instead of and/or in addition to steam boxes placed before the calender.

BRIEF DESCRIPTION OF THE DRAWINGS

With a view to explaining the advantages and details of the invention, the invention will be described below by means of one embodiment thereof, regarded as advantageous, by way of example with reference to the accompanying patent drawing of FIG. 1 which schematically shows a multinip calender in accordance with the invention.

DESCRIPTION OF THE PREFERRED EMBODIMENTS

Figure 1:
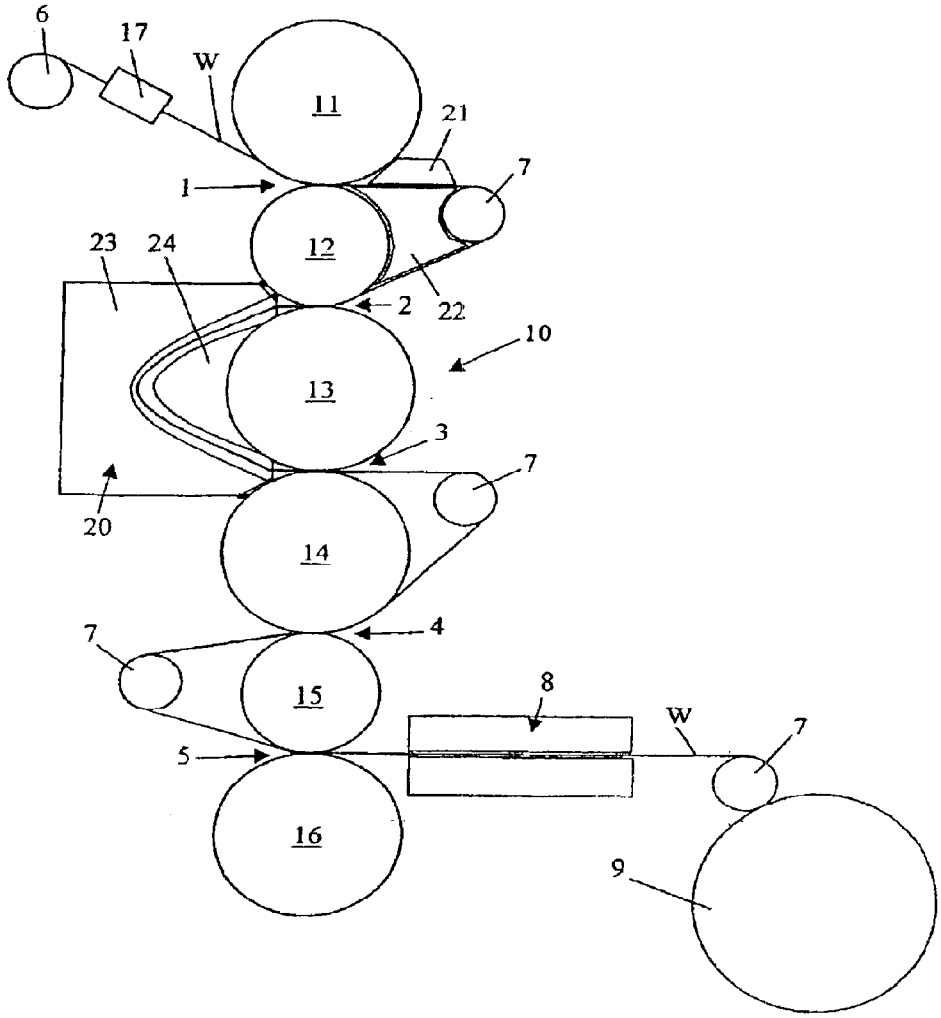
Figure 2:
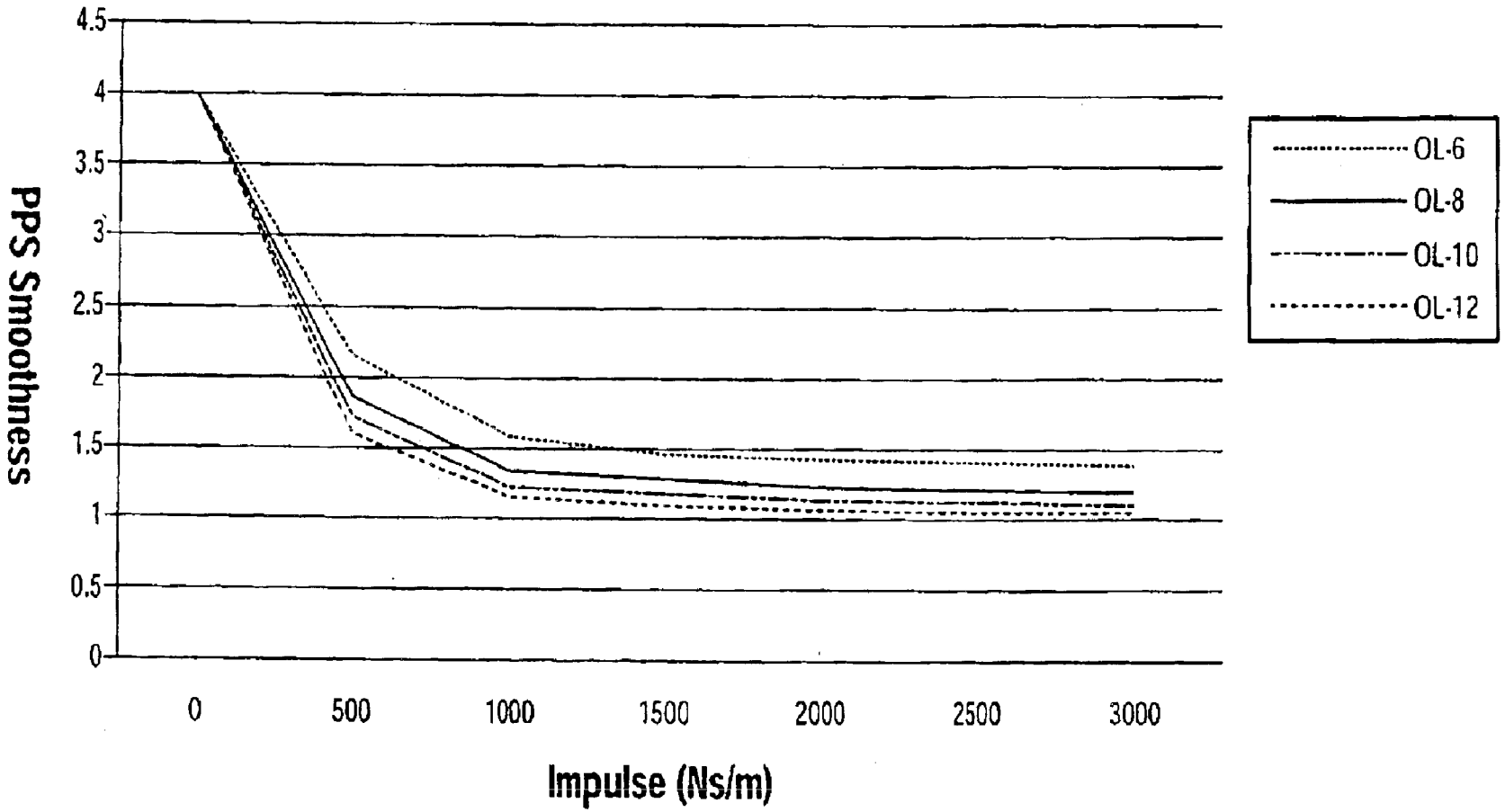
FIG. 2 is a graph showing the smoothness/work done on OptiLoad™ calenders.

As shown in FIG. 1, a multinip calender 10 is a calender of the supercalender type which comprises six rolls 11, 12, 13, 14, 15 and 16 and five nips 1, 2, 3, 4 and 5. In order to treat the sides of a web W, one nip 3 of the supercalender 10 is a so-called reversing nip, in which there are two resilient-surface rolls 13 and 14 against each other. This reversing nip 3 is in the running direction of the web W after the two topmost nips 1 and 2 before the two lowermost nips 4 and 5, in which connection substantially identical nip impulses can be applied to the web W before and after the reversing nip 3.

Polymer is a general name of macromolecular compounds. In partially crystalline polymers, such as in mechanical pulps, the composition of pulps corresponds to the original composition of wood, in which connection molecules are in the crystalline and amorphous regions. Typically, wood contains three different types of biopolymer: partially crystalline cellulose (crystallinity degree 45–90%), amorphous hemicelluloses and amorphous lignin. The proportion of these to one another varies from tree species to tree species. Norway spruce (*Picea abies*), which is most commonly used as raw material for mechanical pulp in the Nordic countries, contains about 42% of cellulose, about 28% of hemicelluloses and about 27% of lignin. The lignin content in chemical pulp is lower than in mechanical pulp. Pine sulphate pulp contains about 75% of cellulose, about 19% of hemicelluloses and about 6% of lignin. Deformations occurring in the fibre polymers of such mechanical and chemical pulps are dependent on time and partly irreversible, i.e. viscoelastic. Viscoelastic behaviour substantially depends on the shear rate, the structure of polymers, and temperature. Since the increase of temperature speeds up the movement of molecules and their segments, the increase of temperature causes the amorphous phase to react more quickly to an external force. In that connection, permanent deformations are brought about in the material by an external force of shorter duration. Below a certain temperature specific to each polymer, the amorphous phase is in the glass state, in which amorphous polymers and the amorphous parts of partially crystalline polymers have solidified so as to be hard and brittle. By the action of an external force, in the glass-state amorphous phase there may occur, in addition to reversible deformation (elastic component), permanent deformation (viscous component), which is called plastic deformation. An increase in the temperature of the amorphous phase occurring in the glass-state region does not affect its viscoelastic behaviour to any significant extent. When the temperature of polymer rises to the glass transition region, all the physical and mechanical properties of the amorphous phase of the polymer change drastically and a considerable increase in the proportion of the viscous component is observed in the viscoelastic behaviour of the amorphous phase. The middle of the glass transition region is known as the so-called glass transition temperature. Below the glass transition temperature, large-scale fast segmental movements of amorphous polymers are totally inhibited, but by raising the temperature in the glass transition region a situation is reached in which polymer segments are capable of sliding past one another because of their thermal energy. As an example of glass transition temperatures it may be mentioned that in bone dry conditions, depending on the crystallinity degree, the glass transition temperatures vary as follows:

for cellulose, in the range of 200. EC–250 EC,
for hemicellulose, in the range of 150 EC–220 EC, and
for lignin, in the range of 130 EC–205 EC.

Moisture has a lowering effect on these temperatures. It shall be noted that lignin is capable of absorbing moisture only to a limited degree, and its glass transition temperature remains constant when the moisture content exceeds 2.5%, and that when the moisture level rises over 5%, it can be found that mechanical pulp has two different glass transition temperatures, a lower one for the cellulose fraction and an upper one for the lignin fraction.

As shown in FIG. 1, the web W runs around a guide roll 6 either, as shown in FIG. 1, via an initial moisturizing device 17, or directly from the guide roll 6, which is enabled by the present invention, into the first, topmost nip 1 of the calender 10, which nip is between the topmost rolls 11 and 12 of the calender. The lower roll of the roll pair 11, 12 is in the example illustrated in FIG. 1 advantageously a smooth-surface press roll 12, such as a metal roll, and the upper roll of the roll pair 11, 12 is advantageously a roll 11 covered with a resilient cover, such as a polymer roll.

From the topmost nip 1, the web W passes further into a secondary moisturizing device 21, 22 which is disposed in connection with the outlet of the first nip 1 and between the outlet of the roll pair 11, 12 forming the topmost nip 1 and a take-out or turning roll 7 placed after the roll pair and referred to hereafter with the term "turning roll". After the secondary moisturizing device 21, 22, the web W runs over the turning roll 7 into the second calendering nip 2, which is formed, like the first nip 1, advantageously between a smooth-surface press roll 12, such as a metal roll, and a roll 13 covered with a resilient cover, such as a polymer roll. A difference between the first and second nips 1 and 2 is that the roll 11 covered with a resilient cover is the upper roll in the first nip 1, while the roll 13 covered with a resilient cover is the lower roll in the second nip 2.

The web W passes from the second nip 2 into an air-float chamber 20 of the turning airborne type of the invention disposed in connection with the outlet of the second nip 2, which chamber also functions as a means for turning the running direction of the web W and for guiding it into the third nip, which is the reversing nip 3 of the calender, said nip being between two rolls 13 and 14 covered with a resilient cover, such as polymer rolls, in which connection work is done to both sides of the web W by means of a resilient-surface roll. In that connection, no turning roll is needed in the portion between the second nip 2 and the third nip 3.

The web W runs from the third nip 3 over a turning roll 7 into the fourth calendering nip 4, which is formed, like the first nip 1, advantageously between a smooth-surface press roll 15, such as a metal roll, which is the lower roll of the fourth nip 4, and a roll 14 covered with a resilient cover, such as a polymer roll, which is the upper roll of the fourth nip 4.

FIG. 1 does not illustrate the possibility that an air-float chamber 20 of the web W according to the invention can also be disposed in connection with the outlet of the first nip 1, the third nip 3 and/or the fourth nip 4.

From the fourth nip 4 the web W runs again over a turning roll 7 into the fifth calendering nip 5, which is formed, like the second calendering nip 2, advantageously between a smooth-surface press roll 15, such as a metal roll, which is the upper roll of the fifth nip 5, and a roll 16 covered with a resilient cover, such as a polymer roll, which is the lower roll of the fifth nip 5.

In the exemplifying case shown in FIG. 1, after the fifth nip 5, the web W is arranged to run via a closed draw instead of a free draw in order that the temperature and moisture content of the web might be regulated by means of a temperature and moisture regulation unit 8, which is, for example, an infrared airborne web-dryer, even still after the fifth nip 5 before the last turning roll 7, from which the web W runs to a reel-up/winder 9.

Thus, in accordance with the invention, there is an air-float chamber of the turning airborne type or an equivalent in connection with the take-out of at least one nip 1, 2, 3, 4, 5 of the calender 10 for the purpose of controlling the moisture content of the web W, which chamber is closed and extends across the entire width of the web W. Advantageously, an air-float chamber 20 is placed in connection with the take-out of each nip 1, 2, 3, 4 and 5 of the calender 10, in which connection the compensation of evaporation and moisture is distributed and equalized uniformly over the entire area of the calender 10. This means that the web will not be liable to large drying/moisturizing cycles, which is advantageous from the point of view of strength, dimensional stability, curling and after-roughening.

In the embodiment shown in FIG. 1, the secondary web moisturizing means 21, 22 is disposed in connection with the lake-out of the first nip 1. The secondary moisturizing means 21, 22 according to this embodiment, situated between the outlet of the nip 1 and the turning roll 7 situated after the roll pair 11, 12 forming the nip 1, is a closed steam or air blow box, spray device, atomizing device or device which operates according to a given control to control evaporation and comprising an upper hood part 21 defining inside it an upper pocket that affects the web W from above and a lower hood part 22 defining inside it a lower pocket affecting the web W from below, said box/device/means extending across the entire width of the web W. In this kind of secondary moisturizing device formed of the hood parts 21 and 22, the web W runs between the hood parts 21 and 22 and it uses steam, water or moist air for moisturizing the web W. It is advantageous that the feed of a moisturizing medium, in particular its feed pressure and feed temperature as well as feed amount, into the upper or the lower hood part 21 or 22 is independent of the feed of a moisturizing medium into the other hood part 22 or 21, respectively, in which connection regulation of the temperature of and evaporation from one side of the web W is independent of the temperature of and evaporation from the other side of the web W. In order that the moisturizing of the web W might also be regulated in the CD direction transverse to the machine direction of the paper machine, it is advantageous that the hood parts 21 and 22 are divided into compartments by means of partition walls in this cross machine direction, in which connection, for example, the edge parts of the web W can be moisturized differently from the middle parts of the web.

In the embodiment shown in FIG. 1, the air-float chamber 20 of the turning airborne type for the web is disposed in connection with the take-out of the second nip 2. The air-float chamber 20 in accordance with this embodiment is closed and extends across the entire width of the web W. In the air-float chamber 20, the run of the web W passes in the air-conditioned passage of the air-float chamber, in which the web W is not in contact with the walls defining the passage and which is defined by an outer blow box 23 and an inner blow box 24, which both blow air or steam to the web, the temperatures, moisture contents and flow quantities of said air or steam being adjustable independently of one another in order to moisturize the web W. It is advantageous that the feed of a medium, in particular its feed pressure, feed temperature and feed quantity, into the outer blow box 23 is independent of the feed of a medium fed into the inner blow box 24 and vice versa, in which connection regulation of the temperature of and evaporation from one side of the web W is independent of regulation of the temperature of and evaporation from the other side of the web W. In order that the moisture content of and evaporation from the web W might also be regulated in the cross direction with respect to the machine direction of the paper machine, it is advantageous that the blow boxes 23 and 24 are compartmentalized or divided in this cross direction, in which connection, for example, the edge parts of the web W can be treated differently from the middle parts of the web.

In accordance with an application of another embodiment of the invention regarded as advantageous, the air-float chamber 20 includes, enclosed in a common housing:

a turning device whose surface facing the web W is curved outwards and which is not in contact with the web, the turning device serving as an inner blow box 24 and its curved surface facing the web W being perforated, and an outer blow box 23 whose surface facing the web W is curved inwards and which is not in contact with the web and whose curved surface facing the web W is perforated.

The curved surface of the outer blow box 23 substantially corresponds in shape to the curved surface of the inner blow box 24, but its radius of curvature is larger than the radius of curvature of the inner blow box 24 for forming for the web W a passage that extends through the air-float chamber 20 and which is not in contact with the web W.

Since in the secondary moisturizing device in accordance with the invention, the hood parts 21 and 22 as well as the blow boxes 23 and 24 blow a feed pressure, feed temperature and feed quantity, into the outer blow box 23 is independent of the feed of a medium fed into the inner blow box 24 and vice versa, in which connection regulation of the temperature of and evaporation from one side of the web W is independent of regulation of the temperature of and evaporation from the other side of the web W. In order that the moisture content of and evaporation from the web W might also be regulated in the cross direction with respect to the machine direction of the paper machine, it is advantageous that the blow boxes 23 and 24 are compartmentalized or divided in this cross direction, in which connection, for example, the edge parts of the web W can be treated differently from the middle parts of the web.

In accordance with an application of another embodiment of the invention regarded as advantageous, the air-float chamber 20 includes, enclosed in a common housing:

a turning device whose surface facing the web W is curved outwards and which is not in contact with the web, the turning device serving as an inner blow box 24 and its curved surface facing the web W being perforated, and an outer blow box 23 whose surface facing the web W is curved inwards and which is not in contact with the web and whose curved surface facing the web W is perforated.

The curved surface of the outer blow box 23 substantially corresponds in shape to the curved surface of the inner blow box 24, but its radius of curvature is larger than the radius of curvature of the inner blow box 24 for forming for the web W a passage that extends through the air-float chamber 20 and which is not in contact with the web W.

Since in the secondary moisturizing device in accordance with the invention, the hood parts 21 and 22 as well as the blow boxes 23 and 24 blow a medium to the opposite surfaces of the web W, the blow flows act as blow flows that reduce the medium flow through the web W, which, on the one hand, assures contactless running of the web W through the secondary moisturizing device 21, 22 and through the air-float chamber 20 and, on the other hand, facilitates the forming of a medium bed, causing the web W to float, between the web W and the lower hood part 22 or the inner blow box 24. An advantage of the medium flows supplied to both sides of the web W is also that the different sides of the web can be treated independently of each other in different ways.

In this connection, it must be noted that, from the point of view of operativeness of the invention, it is not necessary to apply medium flows to both sides of the web W in the secondary moisturizing device 21,_22 or in the air-float chamber 20, since it is sufficient for adequate control of evaporation and moisture that the medium flow is applied only to one surface of the web W, in which connection it is advantageous that the medium flow is directed at the web such that it is possible to achieve the effect of floating the web W.

Above, the invention has been described only by way of example with the help of some of its embodiments regarded as advantageous. This is, of course, not intended to limit the invention and, as is clear to a person skilled in the art, many different alternative arrangements and modifications are feasible within the inventive idea and in its scope of protection defined in the accompanying claims. It shall be particularly noted that the invention can be used widely in different multinip calender applications and that also other gaseous mediums can be used instead of air and steam

What is claimed is:

1. A method for controlling evaporation and moisture in a multinip calender when a continuous fibrous web is calendered in a plurality of calendering nips placed one after the other before the fibrous web is wound on a reel-up/winder, comprising the step of passing the web which is calendered from an outlet of at least one nip into an air-float chamber of the turning airborne type, to make the net evaporation from and the final moisture content of the web constant when the running situations in the calender change.

2. The method of claim 1, wherein an air-float chamber is arranged in connection with the outlet of several nips of the plurality of calendering nips of the multinip calender.

3. The method of claim 2, wherein the multinip calender plurality of nips includes a last nip, and wherein each nip has an associated outlet, and wherein an air-float chamber is arranged in connection with the outlet of each nip of the calender except the last nip of the calender.

4. The method of claim 1 wherein, the web is moisturized in proportion to the amount of liquid evaporating from the web during calendering in order to prevent large drying/moisturizing cycles.

5. The method of claim 1, wherein the web is calendered in at least one calendering nip after the air-float chamber in the glass transition region of the web at a temperature corresponding to at least the glass transition temperature of the web.

6. An arrangement for controlling evaporation and moisture in a multinip calender for the calendering of a continuous fibrous web, the arrangement comprising:

a plurality of calendering nips placed one after the other, wherein the web passes through each of the plurality of calendering nips;

a reel-up/winder which winds the web after it has passed through the plurality of calendering nips; and an air-float chamber of the turning airborne type in connection with the outlet of at least one of the plurality of calendering nips, the web passing through said air-float chamber, the air-float chamber serving to make the net evaporation from and the final moisture content of the web constant when the running situations in the calender change.

7. The arrangement of claim 6, wherein an air-float chamber is in connection with an outlet of each of several nips of the plurality of calendering nips of the multinip calender.

8. The arrangement of claim 7, wherein the plurality of calendering nips includes a last nip, and wherein each nip has an associated outlet, and wherein an air-float chamber is arranged in connection with the outlet of each nip of the calender except the last nip of the calender.

9. The arrangement of claim 6 wherein the air-float chamber further comprises a moisturizing device, whereby web is moisturized in proportion to the amount of liquid evaporating from the web during calendering, in order to prevent evaporation of moisture and large drying/moisturizing cycles.

10. The arrangement of claim 6, wherein, after the air-float chamber, the temperature of the web, when it is calendered, is in the glass transition region of the web in at least one calendering nip, the web being at a temperature corresponding to at least the glass transition temperature of the web when it is calendered.

11. The arrangement of claim 6, wherein the air-float chamber includes a closed evaporation control device operating according to a given control.

12. The arrangement of claim 11 wherein the closed evaporation control device comprises a blow box.

13. The arrangement of claim 6, wherein the air-float chamber is closed and comprises two blow boxes spaced from each other such that between the blow boxes there is a passage for the web for turning the running direction of the web.

14. The arrangement of claim 13, wherein the air-float chamber comprises, enclosed in a common housing:

an inner blow box having a surface facing the web which is curved outwards and which is not in contact with the web; and an outer blow box having a surface facing the web which is curved inwards and which is not in contact with the web, wherein the curved surface of the outer blow box substantially corresponds in shape to the curved surface of the inner blow box but has a radius of curvature larger than the radius of curvature of the inner blow box in order to form a passage for the web, which passage extends through the air-float chamber and is not in contact with the web.

15. The arrangement of claim 14, wherein the feed of a medium, including its feed pressure, feed temperature and feed quantity, into one blow box is independent of the feed of a medium fed into the other blow box, in which connection control or regulation of the temperature, moisture of and evaporation from one side of the web is independent of the moisture, temperature of and evaporation from the other side of the web.

16. The arrangement of claim 13 wherein the blow boxes are arranged to moisturize the web in a cross direction such that the edge parts of the web can be treated differently from the middle parts of the web, to control moisture of and evaporation from the web in the cross direction with respect to the machine direction of the paper machine.

17. The arrangement of claim 6, wherein the web passes through a moisturizing device, and wherein a moisturizing medium in the moisturizing device is air, steam or an equivalent gaseous medium.

18. A papermaking calender apparatus for the calendering of a continuous fibrous web, the apparatus comprising:

a plurality of calendering nips placed one after the other, wherein the web passes through each of the plurality of calendering nips;

an upper roll;

a lower roll, wherein the lower roll engages against the upper roll to define one of said plurality of calendering nips;

a reel-up/winder which winds the web after it has passed through the plurality of calendering nips; and an air-float chamber of the turning airborne type in connection with the outlet of said one of said plurality of calendering nips, the web passing through said air-float chamber, the air-float chamber affecting the net evaporation from and the final moisture content of the web.

19. The papermaking calender apparatus of claim 18, wherein the air-float chamber comprises, enclosed in a common housing:

an inner blow box having a surface facing the web which is curved outwards and which is not in contact with the web; and an outer blow box having a surface facing the web which is curved inwards and which is not in contact with the web, wherein the curved surface of the outer blow box substantially corresponds in shape to the curved surface of the inner blow box but has a radius of curvature larger than the radius of curvature of the inner blow box in order to form a passage for the web, which passage extends through the air-float chamber and is not in contact with the web.

20. The papermaking calender apparatus of claim 19, wherein the feed of a medium, including its feed pressure, feed temperature and feed quantity, into one blow box is independent of the feed of a medium fed into the other blow box, in which connection control or regulation of the temperature, moisture of and evaporation from one side of the web is independent of the moisture, temperature of and evaporation from the other side of the web.

* * * * *